United States Patent [19]

Shoemaker et al.

[11] 3,951,681

[45] Apr. 20, 1976

[54] METHOD FOR DESCALING FERROUS METALS

[75] Inventors: Robert H. Shoemaker, Royal Oak; William G. Wood, Grosse Pointe Park, both of Mich.

[73] Assignee: Kolene Corporation, Detroit, Mich.

[22] Filed: Nov. 1, 1973

[21] Appl. No.: 411,993

[52] U.S. Cl. ..... 134/2; 134/29; 134/30

[51] Int. Cl.[2] ..... C23G 1/14; C23G 1/28

[58] Field of Search ..... 134/2, 26, 29, 28, 30; 148/15, 20; 252/86, 79.5

[56] References Cited

UNITED STATES PATENTS

| | | | |
|---|---|---|---|
| 2,458,661 | 1/1949 | Webster et al. | 134/27 X |
| 2,828,193 | 3/1958 | Newman | 252/79.3 X |
| 3,446,715 | 5/1969 | Frey | 252/86 X |
| 3,506,487 | 4/1970 | Lenz et al. | 134/2 |
| 3,553,015 | 1/1971 | Dohogne | 134/29 X |
| 3,847,663 | 11/1974 | Shumaker | 134/29 X |

OTHER PUBLICATIONS

Metals Handbook, 8th Edition, Vol. 2, 1964, pp. 312, 356–359, 600–601.

Loucks, "Boosting Capacities with Chemicals", Chemical Engineering, 2/26/73, pp. 79–81.

Metallurgia, Durkin—"How to Descale Titanium", 1954, p. 256.

*Primary Examiner*—S. Leon Bashore
*Assistant Examiner*—Marc L. Caroff
*Attorney, Agent, or Firm*—Cullen, Settle, Sloman & Cantor

[57] ABSTRACT

A ferrous metal product to be cleaned is immersed in an oxidizing molten salt bath forming a conditioned scale on the surface of the metal. The conditioned scale is subsequently removed from the metal surface by immersing the metal product in an aqueous caustic bath containing alkali metal hydroxide with alkali gluconate and triethanolamine serving as sequestering agents. The caustic bath may optionally include a brightening catalyst or ethylenediamine-tetracetic acid.

4 Claims, No Drawings

METHOD FOR DESCALING FERROUS METALS

BACKGROUND OF INVENTION

Various alkaline based solutions have previously been employed to remove scale from metal surfaces. For example, Webster et al., U.S. Pat. No. 2,458,661 discloses a fused molten alkali salt solution for removing oxide scale and the like from metal surfaces resulting from the forming operation. Further, Shoemaker et al., U.S. Pat. No. 3,260,619 discloses a different molten alkali salt solution to overcome certain problems associated with the disclosed solution in the Webster Patent. However, both these patents contemplate the use of a further conventional acidic bath to remove conditioned scale on the metal surface which results from treatment following the molten alkali solution bath. Such acidic baths include, for example, sulfuric acid, hydrochloric acid which may be in the form of sodium chloride added to sulfuric acid, nitric acid, hydrofluoric acid and the like, alone or in combination, maintained at elevated temperatures, for example, in excess of about 100°F (37°C). It is the problems associated with these acid baths which the present invention intends to overcome by the provision of a gluconate caustic mixture. Although gluconate mixtures are generally known for the removal of rust and some ferrous scale, none have been applied in the field of alloy processing following salt bath conditioning.

The paramount problem associated with acidic solutions for removing conditioned scale on metal surfaces is that of solution disposal. First, disposal is expensive due to the substantial tonnage of such acids used in the descaling process. Further, disposal of such solutions adds to the presently ever-growing pollution problem. In addition to the problem of disposal, acidic solutions, even though dilute, tend to attack the metal surface. Such attack not only creates an undesirable effect on the metal surface, but adds to disposal problems because of greater metal loss within the descaling operation. Further, the use of acidic descaling solutions requires that the metal be rinsed following the molten alkali bath, since alkali carryover has a deleterious effect on the acid solution.

Accordingly, it is a primary object of the instant invention to provide a non-acidic solution and method for removing conditioned scale from the surface of various metals.

Another object of this invention is the provision of a descaling solution which does not present a pollution problem upon disposal.

A further object of this invention is providing a solution which is stable, exhibits a good life and rejects metal buildup in the form of a precipitate.

Additionally, it is an object of the present invention to provide a solution which is soluble in water and will offer no particular rinsing problems.

SUMMARY OF THE INVENTION

The present invention relates generally to methods and compositions for removing conditioned scale from metal surfaces. More particularly, the present invention relates to a gluconate triethanolamine, caustic solution and method for removing conditioned scale from metal surfaces following a molten alkali salt bath treatment.

The disclosed method contemplates the primary steps of: first, immersing a metal into a molten salt bath; second, removing the metal from the molten bath and allowing the metal to cool prior to further treatment; and third, immersing the metal in a caustic bath solution to remove surface scale. The caustic bath is a water solution containing a mixture of from about 20 to 95% by weight of an alkali hydroxide and from about 5 to 80% by weight of an alkali gluconate and about 1 to 6% triethanolamine, which serves as a chelating agent. The hydroxyl groups in the gluconate ion are converted to methoxide functions which are extremely effective for sequestering trivalent metal ions acting to dissolve the conditioned scale. The complexing action of the gluconate and triethanolamine further reduces the concentration of metal particles within the solution so that additional metal scale can be dissolved. The mixture, which is preferably in concentrations within the solution from about 2 to 12 lbs. per gallon of water, may further include other compositions such as complexing agents for inorganic salts and alkali catalysts to enhance the cleaning capabilities of the solution.

The method and composition of the present invention may optionally include the maintenance of an electric current on the caustic bath by using the metal to be cleaned as an anode, to even further enhance the cleaning capabilities. Furthermore, a later electrolytic solution and step may optionally be included within cleaning process for removing stubborn scale or film.

The gluconate, caustic mixture and method of the present invention are primarily designed for removing conditioned scale from stainless steel metal products. However, the present invention has also been found to be effective in descaling carbon steel, titanium alloys, some high temperature alloy grades, and cast iron. In the process of removing scale from cast iron, the molten salt bath may include an electrolytic process to remove sand and graphite.

The particular advantages of the present invention satisfy the objects previously enumerated. Specifically, the present solution and method accomplishes a commercially clean metal surface which does not require acid pickling. As a necessary consequence of substituting an alkaline solution for an acid cleaning solution, metal surface attack is eliminated as well as many pollution problems associated with acid disposal. Disposal of the gluconate caustic solution can be accomplished by evaporation to dryness by conversion to harmless carbonate.

DETAILED DESCRIPTION

Consistent with the above objectives and summarized description, it has been found that a caustic water solution containing a material found of the following mixture has all of the desired properties and characteristics:

| MATERIAL | RANGE, PER CENT BY WEIGHT OF MIXTURE | PREFERRED, PER CENT BY WEIGHT OF MIXTURE |
|---|---|---|
| SODIUM HYDROXIDE NaOH | 20°–95 | 77 |
| SODIUM GLUCONATE $HOCH_2(CHOH)_4COONa$ | 5 – 80 | 20 |
| ETHYLENE-DIAMINE-TETRACETIC ACID (EDTA) | 0 – 0.4 | 0.2 |
| SODIUM CHLORIDE NaCl or SODIUM FLUORIDE NaF | 0.0 – 1.7 | 1.7 |

-continued

| MATERIAL | RANGE, PER CENT BY WEIGHT OF MIXTURE | PREFERRED, PER CENT BY WEIGHT OF MIXTURE |
|---|---|---|
| TRIETHANOLAMINE | 0 – 6 | 1.0 |

In addition to the compound set forth in the table above, the mixture may also include traces of other common compounds, such as a wetting agent, an alkali stable organic dye, carbonates, borates, and phosphates. Further, although sodium is the primary alkali described in combination with the various other compounds, other alkali could be used in place of sodium hydroxide. For example, the mixture could consist of potassium hydroxide with a potassium gluconate.

Although each of the materials forming part of the bath of this invention are known in and of themselves for use in the treatment of metals, the particular combination defined hereby and the specific quantitative relationship between the components of the mixture provide a synergistic result not realizable from the individual materials or other combinations. Specifically, sodium hydroxide is commonly used to dissolve the iron oxide scales. However, this constituent is primarily used in molten salt baths of the types previously discussed with regard to the Webster and Shoemaker Patents. In contrast the mixture containing sodium hydroxide forming the present invention is maintained at a temperature of between 200°F. and 240°F. (93° and 116°C) for the specific purpose of removing conditioned scale which has formed on metals subsequent to a prior salt treatment. When in solution, the sodium or other alkali readily dissociates, leaving a hydroxide ion which reacts with the sodium gluconate and triethanolamine complexes to dissolve the surface layer of metal scale on the metal to be cleaned. It is known that a gluconate anion is especially effective as a sequestering agent in alkaline and free caustic soda solutions. However, when gluconate and sodium hydroxide are mixed, its hydroxyl groups are converted to a methoxide group which is extremely effective for sequestering trivalent metal ions. The specific combination set forth in the present invention therefore performs the function of an acid pickling bath without the previously disadvantages associated with an acid solution. It can be seen from the above chart that the preferred percentage of sodium hydroxide is relatively high in order to accomplish the specific purpose of the bath.

The ethylene-diamine-tetracetic acid (hereby referred to as EDTA), a complexing agent for inorganic salts, is maintained in solution for the purpose of complexing salts which may carry over into the caustic solution from the molten salt bath and as preferential chelate for calcium and magnesium in hard water, thus releasing gluconate ion for chelation of iron.

Optionally, sodium chloride or sodium fluoride can be included within the mixture to serve as a brightening catalyst for the metal surfaces.

With regard to the treating methods, the metal to be cleaned is first immersed in a molten salt bath, as more fully described in the Webster and Shoemaker Patents previously discussed, to condition and oxidize furnace oxidation and vitreous coatings remaining on the metals as a result of the formation process. After this elevated temperature salt bath process, the metal is then cooled. Optionally, the metal is then rinsed to remove at least a part of the salt precipitants remaining on the metal from the molten salt bath. However, this rinsing process is not critical when employing the descaling solution of the present invention because carryover of salt precipitants into the alkaline based bath does not create a harmful effect as it would in acid baths. The metal oxides formed on the surface of the metal during heat treatment have now been further oxidized by the molten salt bath and present an unsightly and unacceptable appearance. Therefore, it is necessary to then immerse the metal within the chelated alkali solution forming the present invention in order to dissolve the metal oxides and produce a bright, metallic color. The desired temperature range of this bath is between about 200° and 240°F (93° and 116°C). Further, with concentrations of the mixture previously described ranging from 2 to 12 lbs. per gallon of water, the resulting pH should be within the strongly alkaline range or above 14.

Following the chelated alkali solution, the metal surface should be finally rinsed and scrubbed to remove all of the free alkaline solution as a final step in preparing a commercially acceptable metal surface.

A further optional feature contemplated by the present invention is the inclusion of an electrolytic step at a desired point within the overall process. It should be noted that although the present invention is designed primarily for removing conditioned oxide scale from the surface of continuous stainless steel strip, it can also be employed to remove conditioned scale from other similar materials such as carbon steel, titanium alloys, some high temperature alloy grades, and cast iron. In the case of cast iron, an electrolytic process is combined with the molten alkali bath in order to effectively and completely remove sand and graphite deposited on the metal surface during the forming process.

Further, an electric current may be maintained in the caustic alkali bath forming the present invention, utilizing the metal to be cleaned as an anode, in order to further enhance the cleaning capabilities. In the case of stainless steel, the preferred current density maintained in the caustic alkali bath ranges between 0.001 and 0.1 amps./sq. in. Such an electrolytic process aids in cleaning the metal surfaces because of the scrubbing action due to the oxygen and hydrogen bubbles forming around the metal, which is acting as an anode.

Additionally, certain grades of stainless steel exhibit a tendency to retain a yellowish cast on their surface following the basic steps of the present invention. To remove this yellowish cast or film, the present invention contemplates an additional step of treating the metal in a 2 to 4% sodium bifluoride solution anodically at a current density of about 0.25 amps./sq. in. The desired current density during any of the previously mentioned electrolytic processes may be maintained according to standard practices recognized within the art, for example by using low carbon steel electrodes with a prescribed exposed surface.

To prepare the bath solution of the present invention, it is suggested that a tank be filled with water to about one-third of the final calculated volume. The previously described mixture should then be added slowly while agitating or stirring the water in order to properly dissolve the mixture. Once the mixture has been dissolved, the balance of the water should then be added and then heated to the proper operating temperature. Stainless steel is the preferred construction for treating tanks and agitators. Alternately a carbon steel tank lined with Teflon may be used.

| Sample No. | Scale Condition | Time Within Molten Salt Bath | Time Within Alkali Gluconate Pickle Bath | Electrolytic Bifluoride Solution |
|---|---|---|---|---|
| 1 | 430 stainless steel annealed for 3½ minutes at 1475°F (802°C) | 1 minute | 1 minute | — |
| 2 | 430 stainless steel annealed | 1 minute | 1 minute | — |
| 3 | 304 hot rolled annealed for 3½ minutes at 1880°F (1027°C) | 1 minute | 1 minute | — |
| 4 | 201 stainless steel annealed for six minutes at 1840°F(1004°C) | 30 seconds | 1 minute | 1 minute |
| 5 | 304 hot rolled annealed for 3½ minutes at 1880°F(1027°C) | 1 minute | 1 minute (electrolytic) | — |

The bath of this invention has been demonstrated to maintain its efficiency over extended periods of time. Of course, small quantities of additional material mixture and water need to be added from time to time to replace losses occurring from dragout of the metal work pieces and evaporation in order to maintain both the volume and desired equilibrium of the bath.

Having described the present inventive concept, the following specific examples will serve to further illustrate the same. However, it should be understood that examples are merely exemplary and not to be interpreted as limiting in any way.

EXAMPLES

To prepare for the examples set forth below, an alkali gluconate pickle bath forming the present invention was prepared to achieve the following approximate composition: 23% sodium hydroxide, 12% sodium gluconate, 0.5% sodium fluoride, 2% triethanolamine, and 62.5% water. The bath was maintained at approximately 220°F. (104°C.) and time cycles were set to coincide with continuous strip pickling. The molten salt bath was maintained at approximately 900°F. (482°C). Small coupons or samples of the various listed grades were first immersed in the molten salt bath, then cooled and water quenched, then pickled in the alkali gluconate bath. It will be noted that Sample 4 was additionally treated in an electrolytic bifluoride solution. This additional step was necessitated for the purpose of removing a very light yellow film remaining on that particular sample of metal after the alkali gluconate bath treatment. That additional electrolytic solution contained approximately 2 to 4% sodium bifluoride, was maintained at approximately 140° to 160°F. (60° to 71° C.), and had a current density of 0.25 amps/sq. in. imposed thereon. It will further be noted that in Sample 5 the alkali gluconate bath is electrolytic to enhance its cleaning capabilities.

In each of the above examples, the described process achieved a commercially clean metal sample. Having fully described the present invention, we

I claim:

1. A method of removing scale from and cleaning ferrous metal surfaces, particularly ferrous oxides and scale remaining on the metal surfaces as a result of the formation process, comprising the steps of:

a. converting the process scale into a conditioned scale on said metal surfaces by immersing the metal in a molten oxidizing salt bath which oxidizes said scale, b. then, removing the conditioned scale from said metal surfaces by immersing the metal in a separate strongly alkaline, non-acidic caustic bath having a temperature of about 200° to 240°F, said caustic bath comprising about 2 to 12 pounds of a mixture of about 20 to 90% of an alkali hydroxide, from about 5 to 80% of an alkali gluconate, 0.1 to 6% triethanolamine, serving as a chelating agent, per gallon of water in a bath.

2. The method defined in claim 1, characterized in that said caustic bath consist essentially of, by weight, 70 to 85% of said alkali hydroxide 12 to 28% of said alkali gluconate, 1 to 6% of said triethanolamine, 0.1 to 0.4% of a complexing agent for inorganic salts and 0.8 to 1.7% of a brightening catalist.

3. The method defined in claim 2, characterized in that said brightening catalist is selected from the group consisting of sodium chloride and sodium fluoride.

4. The method defined in claim 1, including maintaining an electric current in said caustic bath, utilizing said metal as an anode, and wherein the current density ranges between about 0.001 and 0.01 amps per square inch.

* * * * *